United States Patent [19]

Bramham

[11] Patent Number: 5,067,921

[45] Date of Patent: Nov. 26, 1991

[54] INFLATABLE IMMERSION SUIT

[75] Inventor: Eric Bramham, Morpeth, United Kingdom

[73] Assignee: Shell Internationale Research Maatschappij B.V., The Hague, Netherlands

[21] Appl. No.: 413,525

[22] Filed: Sep. 27, 1989

[30] Foreign Application Priority Data

Sep. 30, 1988 [GB] United Kingdom ..... 8822943

[51] Int. Cl.[5] ..... B63C 9/08

[52] U.S. Cl. ..... 441/102; 441/105; 441/90; 2/2

[58] Field of Search ..... 441/80, 88, 102-108, 441/111-119; 2/2, 2.1 R, 82, 87

[56] References Cited

U.S. PATENT DOCUMENTS

| | | | |
|---|---|---|---|
| 1,851,100 | 3/1932 | Iig | 441/105 |
| 3,369,263 | 2/1968 | Kreckl | 441/104 |
| 3,392,405 | 7/1968 | Ritzinger, Jr. et al. | 441/103 X |
| 3,747,141 | 7/1973 | Crockford | 441/103 |
| 4,023,223 | 5/1977 | Anderson et al. | 441/104 |
| 4,097,947 | 7/1978 | Kiefer | 441/106 |
| 4,734,072 | 3/1988 | Lastnik | 441/105 |

FOREIGN PATENT DOCUMENTS

| | | | |
|---|---|---|---|
| 480574 | 1/1952 | Canada | 441/104 |

*Primary Examiner*—Ed Swinehart

*Attorney, Agent, or Firm*—Jones, Tullar & Cooper

[57] ABSTRACT

An inflatable immersion suit is provided with an inner layer which is inherently more elastic than the outer layer so as to ensure a close fitting of the inflated suit around the body of the wearer, thereby providing effective anti-hypothermia protection to the wearer.

6 Claims, 2 Drawing Sheets

INFLATABLE IMMERSION SUIT

The invention relates to an inflatable immersion suit.

Immersion suits of this type are constructed of two layers of material fabricated such that the gap between the layers is in the form of at least one sealed compartment. This compartment is generally voided in normal circumstances, but when the wearer becomes a survivor on being cast in the sea it can be inflated to provide a contained gas layer principally giving buoyancy to assist flotation but also acting as insulation.

The provision of thermal insulation is important in case of immersion in cold waters such as the North Sea. If the human body is immersed in cold water at or near the freezing temperature the cooling effect of the water may rapidly cause hypothermia and thus a drastically reduced blood circulation. It is known e.g. from British patent specification 1205062 to provide thermal insulation by means of a wet suit which admits some water to reach the wearer's skin but which minimizes throughflow via the garment. It is also known to provide thermal insulation by means of a dry suit which prevents contact of the water with the wearer's skin.

Dry suits are currently available for use as an overall type of survival suit which covers underlying clothing of for instance helicopter transit passengers. The present overall suits rely on their watertightness to work and a close fitting of the suit around the waist and the neck of the wearer is required since leakage of about 250 ml of water into the suit may already drastically impair its insulating properties. Accordingly disadvantages of the known overall suits are that they are uncomfortable to wear and that even a small leakage of water destroys their effectiveness.

It is an object of the present invention to remedy the disadvantages of the known immersion suits and to provide a reliable immersion suit which is comfortable to wear.

The immersion suit according to the invention comprises an inner and an outer layer of an impermeable material, the inner layer being made of an inherently more elastic material than the outer layer, and a spacing between said inner and outer layer, said spacing forming a sealed compartment which can be inflated in an emergency situation.

In a preferred embodiment of the invention the outer layer is made of a polyurethane directly coated fabric having a total weight of at least 270 grams per square metre whereas the inner layer is made of a polyurethane coated fabric which is extensible in all directions to allow stretching on inflation.

It is a key feature of the present invention that the relatively large elasticity of the inner layer ensures a close fitting of the inflated suit around the body of the wearer thereby serving to limit the amount of free water that can flush its way between the wearers body and the unit. The relatively low elasticity of the outer layer, on the other hand, avoids an uncontrolled inflation of the suit to a balloon-like shape.

Other purposes, distinctions over the art, advantages and features of the invention will be apparent to one skilled in the art upon review of the accompanying drawings, in which.

Figure 1:
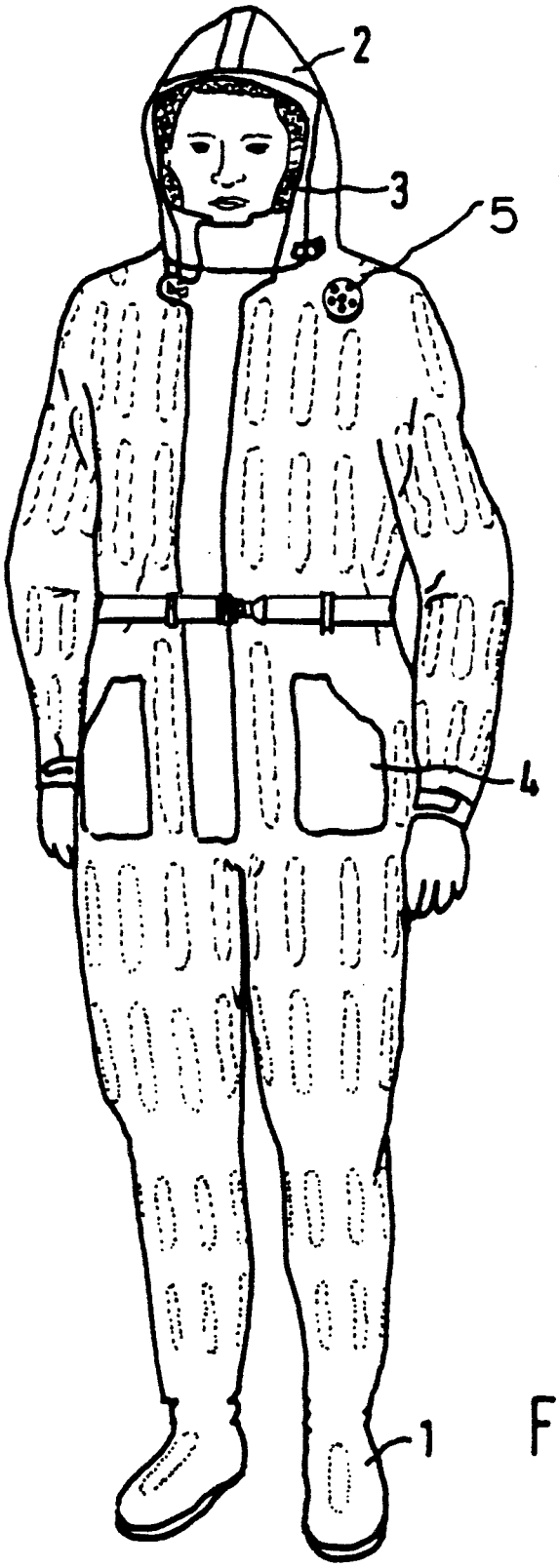
FIG. 1 shows an inflatable immersion suit according to the invention.
Figure 4:
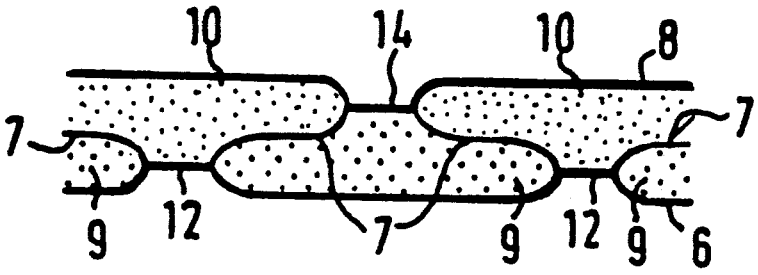
FIG. 4 is a section through the suit when seen along line A—A in FIG. 3 in the direction of the arrows.

Referring now to FIG. 1 there is shown an immersion suit according to the invention. The suit comprises integral boots 1 and an inflatable hood 2 incorporating a transparent splash guard 3 to protect the wearers face. The suit is further equipped with pockets 4 which act as mufflers whilst awaiting rescue. As can be seen in FIG. 4 the suit is built up of an outer layer 6, an intermediate layer 7 and an inner layer 8 which is inherently more elastic than the outer and intermediate layer. The intermediate layer divides a gap between the inner and outer layer 8 and 6 into two sealed compartments 9 (dotted) and 10 (hatched) which can be separately inflated. Accordingly the suit is fully inflated in two stages: 50% takes place in both compartments 9 and 10 simultaneously even though each compartment is separate. Full inflation is achieved by subsequently activating a second $CO_2$ cylinder to fully inflate both compartments at the same time.

The separated compartments 9 and 10 ensure that the insulation is not totally lost if the inner or outer layer would be torn in any way. As shown in FIG. 1 the suit may in addition or alternative to the $CO_2$ cylinder be provided with an oral inflator 5 which may simultaneously act as a pressure relief valve.

In the embodiment shown the outer layer 6 and intermediate layer 7 are made of a polyurethane coated fabric having a total mass of at least 270 grams per square metre whereas the inner layer is made of a polyurethane coated fabric which is extensible in all directions to allow stretching on inflation. The modulus of elasticity of the inner layer 8 is at least 10% smaller than the modulus of elasticity of the intermediate and outer layers.

The relatively high elasticity of the inner layer 8 serves to achieve a close fitting of the inflated suit around the body of the wearer, thereby serving to limit the amount of free water that can flush its way between the suit and the body. During normal use the suit may allow ingress of relatively large quantities of water. However, when the wearer becomes a survivor on being cast in the sea inflation of the suit will drive the water out of the space between the suit and the body, thereby providing anti-hypothermia protection to the wearer.

The design of the suit is such that in the region of the chest and shoulders of the wearer the volume of the inflated compartments 9, 10 is larger than the volumes of these compartments in other regions of the suit. In this manner the suit becomes self righting so that it turns the face of the wearer in the upward direction upon immersion. The inherent stability of the inflated suit eliminates the necessity of using a separate inflatable life jacket as currently used with dry survival suits.

Figure 2:
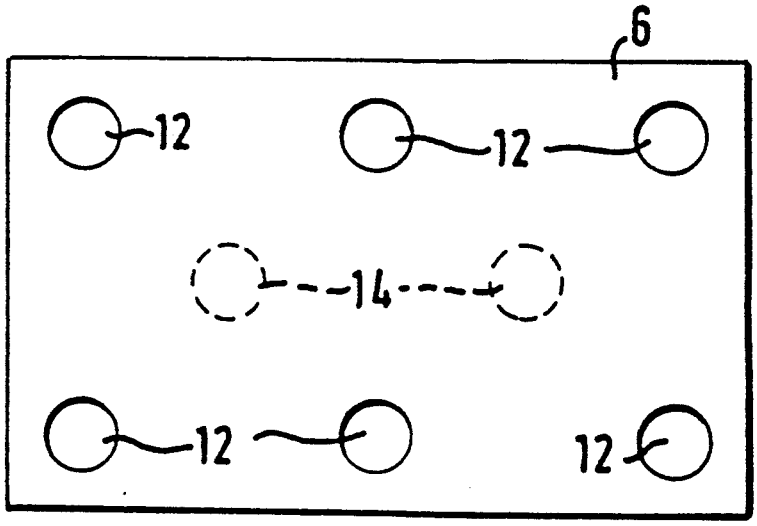
FIG. 2 is a plan view of a section of the outer layer of the suit shown in FIG. 1.
Figure 3:
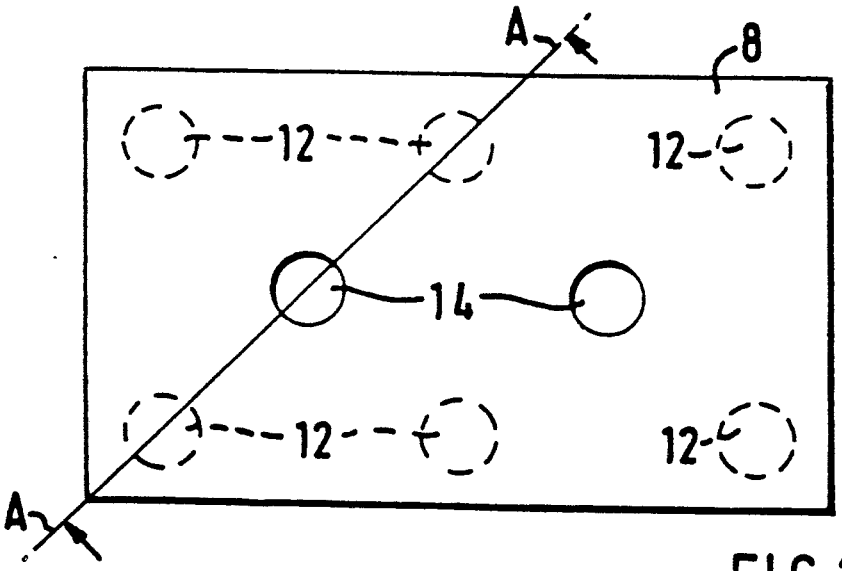
FIG. 3 is a plan view of the inner layer of the suit shown in FIG. 1.

FIGS. 2 and 3 show how the intermediate layer 7 is welded in regular patterns to the inner and outer layer 8 and 6. FIG. 2 is a plan view of the outer layer 6 showing the lay out of the pattern. Solid lines indicate the welding points 12 between the outer layer 6 and intermediate layer 7. Dotted lines indicate the welding points 14 between the inner layer 8 and the intermediate layer 7.

FIG. 3 is a plan view of the inner layer 8. In FIG. 3 solid lines indicate the welding points 14 between the inner layer 8 and intermediate layer 7 whereas the welding points 12 between the outer layer 6 and intermediate layer are indicated by dotted lines 12.

As can be seen in FIGS. 2 and 3 the welding points 12 and 14 form overlapping patterns such that each welding point 14 is located in the centre of a square formed by four adjacent welding point 12 and vice versa. As shown in FIG. 4 the staggered arrangement of the welding points 12 and 14 ensures that when the compartments 9 and 10 are inflated the inner and outer layer 8 and 6 are parallel to one another but do not connect with each other, thus giving a high level of thermal resistance.

It will be understood that instead of the staggered arrangement of the welding points 12 and 14 other welding patterns may be used as well. The welding points 12 and 14 may be created by a high frequency welding technique or any other suitable welding technique.

Generally it is preferred to limit the overpressure in the compartments 9 and 10 of the inflated suit to about 0.06 bar to avoid having the suit become too restrictive. However there are applications where higher pressure could be advantageous, for instance if the suit is simultaneously used as a "G" suit for pilots. The suit may further be equipped with additional rescue equipment such as a light flash and an artificial lung which allows the wearer to breathe underwater or in a smoky or poisonous atmosphere.

It will further be understood that instead of the overall suit covering the whole body of the wearer as shown in FIG. 1 the survival suit may cover only part of the body of the wearer as well. The suit may be formed by a vest, jacket or by a combination of a jacket and separate trousers. Accordingly it is to be clearly understood that the embodiment of the suit shown in the drawing is illustrative only.

I claim:

1. An inflatable immersion suit comprising:

an inner and an outer layer of an impermeable material, the inner layer being made of an inherently more elastic material than the outer layer, a spacing between said inner and outer layers, said spacing forming a sealed compartment that can be inflated in an emergency situation, an intermediate layer which interconnects the inner and outer layers so that the three layers are fastened together in such a pattern that the intermediate layer divides the spacing into a plurality of separated compartments and that the inner and outer layers are substantially parallel to each other and are not in direct contact with each other, wherein the intermediate layer divides the spacing into two separated compartments which are individually inflatable with a gas, and wherein the intermediate layer is connected to the inner and outer layers by matrices of welding points which are spread in alternating patterns over the surface of the suit such that a welding point between the intermediate layer and one of said inner and outer layers is located in the centre of a square formed by four adjacent welding points between the intermediate layer and the other of said inner and outer layers.

2. The immersion suit of claim 1, wherein the suit is designed as an overall suit equipped with integral boots and a hood incorporating a transparent splash guard to protect the face of the wearer.

3. The immersion suit of claim 1, wherein in the region of the shoulders and chest of the wearer the volume of the suit when inflated is larger than the volume of the inflated suit in other regions thereof.

4. The immersion suit of claim 1, wherein the gas is carbon dioxide.

5. The immersion suit of claim 1, wherein the gas is air.

6. An inflatable immersion suit comprising:

an inner and an outer layer of an impermeable material, the inner layer being made of an inherently more elastic material than the outer layer, a spacing between said inner and outer layers, said spacing forming a sealed compartment that can be inflated in an emergency situation, an intermediate layer which interconnects the inner and outer layers so that the three layers are fastened together in such a pattern that the intermediate layer divides the spacing into a plurality of separated compartments and that the inner and outer layers are substantially parallel to each other and are not in direct contact with each other, wherein the intermediate layer is connected to the inner and outer layers by matrices of welding points which are spread in alternating patterns over the surface of the suit such that a welding point between the intermediate layer and one of said inner and outer layers is located in the centre of a square formed by four adjacent welding points between the intermediate layer and the other of said inner and outer layers.

* * * * *